United States Patent [19]

Shimoya et al.

[11] Patent Number: 4,599,498

[45] Date of Patent: Jul. 8, 1986

[54] TAMPER SWITCH

[75] Inventors: Shigeo Shimoya, Kitamoto; Hikoji Iwasaki, Konosu, both of Japan

[73] Assignee: Kobishi Electric Co., Ltd., Tokyo, Japan

[21] Appl. No.: 691,276

[22] Filed: Jan. 14, 1985

[51] Int. Cl.[4] ..... H01H 15/00; H01H 3/16; H01H 13/50

[52] U.S. Cl. ..... 200/16 B; 200/61.76; 200/159 A

[58] Field of Search ..... 200/61.76–61.82, 200/61.62, 16 A, 16 B, 16 E, 159 R, 159 A, 243, 275

[56] References Cited

U.S. PATENT DOCUMENTS

| | | | |
|---|---|---|---|
| 1,527,026 | 2/1925 | Cadieux | 200/16 B |
| 2,065,904 | 12/1936 | Meuer | 200/61.76 X |
| 2,155,765 | 4/1939 | Meuer | 200/61.76 |
| 3,818,169 | 6/1974 | Kobernus | 200/159 A |
| 3,902,032 | 8/1975 | Koepke | 200/159 A X |
| 3,924,090 | 12/1975 | Chao et al. | 200/159 A |
| 4,361,743 | 11/1982 | Ayers | 200/159 A X |

*Primary Examiner*—J. R. Scott
*Attorney, Agent, or Firm*—Darby & Darby

[57] ABSTRACT

A tamper switch includes an elongated tamper element mounted on a casing for movement along an axis thereof between an inoperative and an operative position. An urging device normally urges the tamper element into one of the operative and inoperative positions. A pair of elongated resilient contact plates are mounted within and fixedly secured to the casing at their one ends, the pair of contact plates being disposed in generally parallel opposed relation to each other. Each of the contact plates has a slit extending along a length thereof and opening to the other end thereof. A contact element is secured to the tamper element. The contact element is urged in between the pair of contact plates to make electrical contact therewith when the tamper element is brought into the operative position. By virtue of the provision of the slit in each contact plate, the contact plate is held in contact with the contact element throughout substantially the entire width thereof.

3 Claims, 12 Drawing Figures

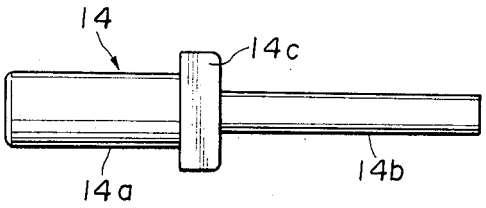
FIG.3
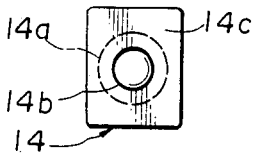
FIG.4
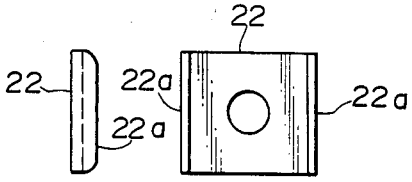
FIG.6
FIG.5
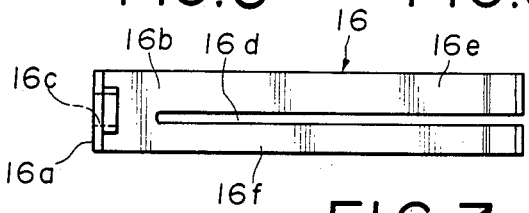
FIG.7
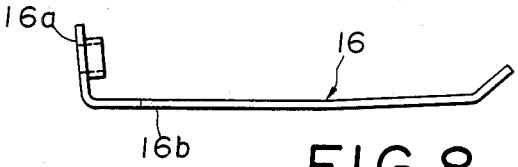
FIG.8
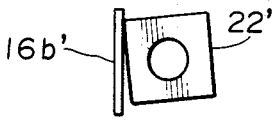
FIG.9B
(Prior Art)
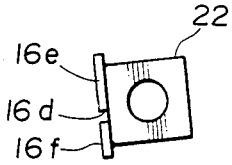
FIG.9A

TAMPER SWITCH

BACKGROUND OF THE INVENTION

This invention relates to a tamper switch for use, for example, as a switch for detecting the removal of a burglar alarm by an unauthorized person or as an interlock switch for electrical equipment.

Generally, burglar alarm devices such as an alarm horn designed to be attached to a wall are provided with a tamper switch for detecting the removal of the switch from the wall by an unauthorized person. The tamper switch is designed to be either turned on or turned off when it is detached from the wall. The opening and closing of such conventional tamper switch are rarely effected, and therefore it is necessary that the contact resistance of the tamper switch should be kept to a low level for a prolonged period of time to ensure that the tamper switch is not subjected to malfunction.

SUMMARY OF THE INVENTION

It is therefore an object of this invention to provide a tamper switch which can keep its contact resistance to a low level for a long period of time and can be manufactured at low costs.

According to the present invention, there is provided a tamper switch comprising a casing; an elongated tamper element mounted on the casing for movement along an axis thereof between an inoperative and an operative position, one end of the tamper element extending exteriorly of the casing; urging means for normally urging the tamper element into one of the operative and inoperative positions; a pair of elongated resilient contact plates mounted within and fixedly secured to the casing at their one ends, the pair of contact plates being disposed in generally parallel opposed relation to each other, each of the contact plates having a slit extending along a length thereof and opening to the other end thereof; and a contact element secured to the tamper element, the contact element being urged in between the pair of contact plates to make electrical contact therewith when the tamper element is brought into the operative position.

BRIEF DESCRIPTION OF THE DRAWINGS

FIG. 3 is an elevational view of a tamper element incorporated in the tamper switch;

FIG. 4 is an end view of the tamper element;

FIG. 5 is a plan view of a contact element incorporated in the tamper switch;

FIG. 6 is a side elevational view of the contact element;

FIG. 7 is a front elevational view of a contact plate incorporated in the tamper switch;

FIG. 8 is a side elevational view of the contact plate;

FIG. 9A is a fragmentary plan view of the tamper switch, showing the contact element in contact with the contact plate;

FIG. 9B is a view similar to FIG. 9A but showing a conventional tamper switch.

DESCRIPTION OF THE PREFERRED EMBODIMENTS OF THE INVENTION

Figure 1:
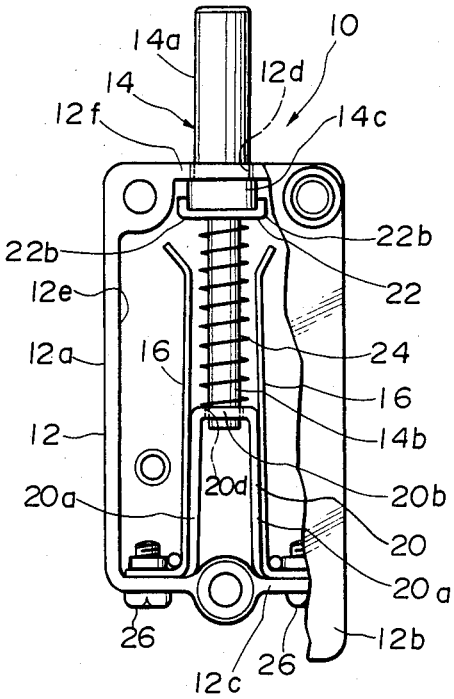
FIG. 1 is a partly broken front elevational view of a tamper switch provided in accordance with the present invention.

Like reference numerals denote corresponding parts in several views.

Figure 2:
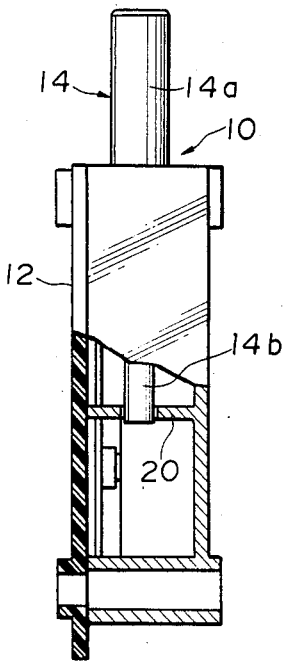
FIG. 2 a partly broken side elevational view of the tamper switch.

A tamper switch 10 shown in FIGS. 1 and 2 comprises a casing 12 an elongated tamper element 14 mounted on the casing 12 for movement along an axis thereof, and a pair of opposed contact plates or strips 16 are mounted within the casing 12.

The casing 12 of a rectangular shape is made of a synthetic resin and includes a body **12*a* having an opening 12*e* and a cover plate 12*b* covering the opening 12*e*. The casing body 12*a* has a guide portion 20 of a channel shaped cross-section formed integrally on one end wall 12*c* thereof and defined by a pair of parallel opposed arms 20*a* and 20*a* and a base 20*b* interconnecting the arms 20*a* and 20*a* at their one ends remote from the end wall 12*c*. The guide portion 20 has an aperture 20*d* formed through the base 20*b***.

The casing body **12*a* has an aperture 12*d* formed through the other end wall 12*f*, the aperture 12*d* being coaxial with the aperture 20*d* of the guide portion 20. As best shown in FIGS. 3 and 4, the tamper element 14 of a synthetic resin has a cylindrical head portion 14*a*, a cylindrical leg portion 14*b* of a reduced diameter, and a square flange 14*c* disposed between the head portion 14*a* and the leg portion 14*b*. A square contact element 22 of an electrically-conductive material is fixedly secured to the flange 14*c* adjacent to the leg portion 14*b*, the contact element 22 having a pair of projections 22*b* formed at opposite edges. The head portion 14*a* of the tamper element 14 is slidably received in the aperture 12*d* of the casing body 12*a* while the free end of the leg portion 14*b* is slidably received in the aperture 20*d* of the guide portion 20**.

A compression coil spring 24 is wound around the leg portion **14*b* and acts between the base 20*b* of the guide portion 20 and the contact element 22 for normally urging the flange 14*c* into contact with the end wall 12*f***.

Each of the contact plates 16 is made of an electrically-conductive resilient metal and has a generally L-shape defined by a base **16*a* and a leg 16*b* extending perpendicularly from the base 16*a* at one end thereof, as best shown in FIGS. 7 and 8, the base 16*a* having an aperture 16*c*** formed therethrough.

The pair of contact plates 16 are fixedly secured to the end wall **12*c* of the casing body 12*a* at their respective bases 16*a* by a pair of screws or volts 26 threaded through the end wall 12*c* and the respective bases 16*a*, the bolts 26 being threaded through the apertures 16*c***, respectively, and serving as terminals connectable, for example, to an alarm circuit (not shown).

In this condition, the legs **16*b* of the two contact plates 16 are held against the pair of arms 20*a* and 20*a* of the guide portion 20 at their proximal portions and are disposed in spaced relation to the coil spring 24 wound around the leg portion 14***b* of the tamper element 14. The distal ends of the contact plates 16 are inclined away from each other.

As shown in FIG. 7, each of the contact plates 16 has a slit 16*d* formed through and extending along the leg 16*b* to provide a pair of contact portions 16*e* and 16*f*, the slit 16*d* opening to the distal end of the contact plate 16 and terminating slightly short of the base 16*a*. The slit 16*d* is offset transversely from the longitudinal axis or center line of the leg 16*b* so that the pair of contact portions 16*e* and 16*f* have different widths.

When the tamper element 14 is moved axially toward the guide portion 20 against the bias of the coil spring 24, the contact element 22 is forced in between the legs 16*b* of the contact plates 16 to urge them to be resiliently flexed away from each other to make electrical contact therewith so that a circuit through the pair of contact plates 16 is closed. In this case, the contact portions 16*e* and 16*f* of each contact plate 16 have relatively reduced widths, respectively, and therefore even if the contact plates 16 are not disposed accurately in parallel relation to the opposite edges 22*a* of the contact element 22, each of the contact portions 16*e* and 16*f* is twisted along the length thereof and is held in contact with the edge 22*a* of the contact element 22 throughout the entire width thereof, as shown in FIG. 9A. As a result, the contact resistance of the tamper switch 10 can be kept to a lower level for a prolonged period of time. If there is provided no slit in a leg 16*b*′ of a contact plate as shown in FIG. 9B, the contact plate 16 offers more resistance to an axial twisting, and therefore if the contact plate is not disposed accurately in parallel relation to the edge of a contact element 22′, the contact plate is held in contact with the edge of the contact element 22′ at a point or small area. This will increase the contact resistance of the switch.

As described above, the slit 16*d* is offset from the center line of the leg 16*b* of each contact plate 16, and therefore the resilient contact portions 16*e* and 16*f* are different from each other in natural frequency to prevent the chattering of the contact portions 16*e* and 16*f*. However, in the case where the chattering poses no serious problem, the slit 16*d* may be formed centrally of the width of the leg 16*b* of each contact plate 16.

Figure 10:
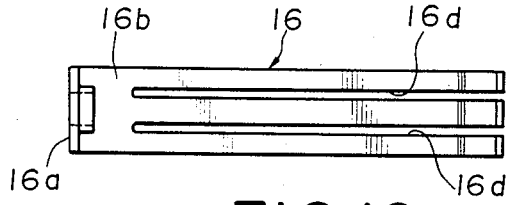
FIG. 10 is a view similar to FIG. 7 but showing a modified contact plate.

According to a modified form of the invention shown in FIG. 10, a plurality of, say, two slits 16*c* are formed through the leg 16*b* of each contact plate 16.

Figure 11:
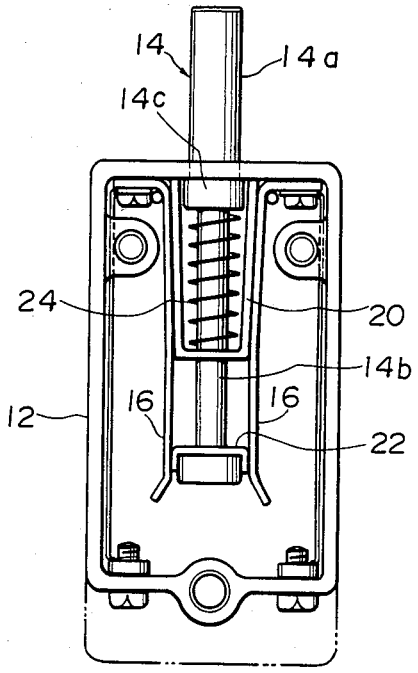
FIG. 11 is a view similar to FIG. 1 but showing a modified tamper switch.

A modified tamper switch shown in FIG. 11 differs from the tamper switch 10 of FIG. 1 in that a compression coil spring 24 normally urges a tamper element 14 into an operative position wherein a contact element 22 is held in electrical contact with a pair of opposed contact plates 16 and 16.

What is claimed is:

1. A tamper switch comprising:

(a) a casing;

(b) an elongated tamper element mounted on said casing for movement along an axis thereof between an inoperative and an operative position, one end of said tamper element extending exteriorly of said casing;

(c) urging mens for normally urging said tamper element into one of said operative and inoperative positions;

(d) a contact element fixedly mounted on said tamper element for movement therewith, said contact element having a pair of parallel planar engaging portions; and (e) a pair of elongated planar resilient contact plates mounted within and fixedly secured to said casing at their one ends, said pair of contact plates being disposed in generally parallel opposed relation to each other, said contact element being urged in between said pair of contact plates to cause said engaging portions to make electrical contact with said pair of contact plates, respectively, when said tamper element is brought into said operative position, each of said contact plates having a slit extending along substantially a major portion of the length thereof and opening to the other end thereof to provide a pair of closely spaced contact portions each capable of being twisted along a length thereof, so that said pair of contact portions of each contact plate are brought into contact with a respective one of said engaging portions generally across the entire widths of the engaging portions.

2. A tamper switch according to claim 1, in which said tamper element is movable along the length of each of said contact plates.

3. A tamper switch according to claim 1, in which said slit is offset from a center line thereof.

* * * * *